US005174738A

United States Patent [19]

Baumann et al.

[11] Patent Number: 5,174,738

[45] Date of Patent: Dec. 29, 1992

[54] SLIDER BLOCK FOR A SCROLL COMPRESSOR HAVING EDGE LOADING RELIEF UNDER LOAD

[75] Inventors: David C. Baumann, Lafayette; Edward A. Tomayko, Cuyler; James W. Bush, Skaneateles; Antonio Prince, Syracuse, all of N.Y.

[73] Assignee: Carrier Corporation, Carrier Parkway, Del.

[21] Appl. No.: 805,739

[22] Filed: Dec. 11, 1991

[51] Int. Cl.[5] ..... F04C 18/04

[52] U.S. Cl. ..... 418/55.5; 418/57; 418/182

[58] Field of Search ..... 418/55.5, 57, 182

[56] References Cited

U.S. PATENT DOCUMENTS 4,808,094 2/1989 Sugimoto et al. ..... 418/55.5
4,836,758 6/1989 Elson et al. ..... 418/55.5

FOREIGN PATENT DOCUMENTS 58-172402 10/1983 Japan ..... 418/182
63-248991 10/1988 Japan ..... 418/55.5

*Primary Examiner*—John J. Vrablik

[57] ABSTRACT

The outer surface of a slider block increases radially with increasing distance from the crankshaft for at least a portion of its height. As a result when the drive pin of the crankshaft deflects under load the slider block moves therewith as a unit. The surface of the slider block maintains an essentially uniform oil film thickness over an extended area due to its shape.

12 Claims, 2 Drawing Sheets

SLIDER BLOCK FOR A SCROLL COMPRESSOR HAVING EDGE LOADING RELIEF UNDER LOAD

BACKGROUND OF THE INVENTION

In some scroll compressors the crankshaft is supported at one end and near the other end such that an eccentric drive pin is overhung or cantilevered with respect to the bearing support. The drive pin coacts with the orbiting scroll of the compressor through a slider block or bushing which permits the drive pin to rotate while the orbiting scroll is held to an orbiting motion through an anti-rotation mechanism such as an Oldham coupling. The coaction between the drive pin and slider block is complicated by the nature of the force transmission. If the contacting members are not aligned, there will be edge loading, but there is a deflection of the cantilevered drive pin and/or crankshaft under load which produces a change in the nature and location of the contact between the drive pin and slider block. This change, in turn, produces changes in the nature and location of the contact between the slider block or bushing and the orbiting scroll which can also produce edge loading.

In U.S. Pat. No. 4,836,758 this deflection of the drive pin and/or crankshaft under load is addressed by having the desired contact take place as a result of the deflection under load. In one example the canting or deflection of the crankshaft causes the drive pin to go from a line contact to an area contact with the slider block or bushing. In a second example the drive pin deflects or cants causing it to go from a line contact to an area contact with the slider block or bushing. In a third example, there is area contact between the drive pin and bushing, but only a line contact between the bushing and hub of the orbiting scroll until deflection of the crankshaft takes place. In each case, the line contact is at the point closest to the orbiting scroll which is the point of greatest overhang. As a result, the forces act at the greatest lever arm until area contact is achieved. Presumably, at forces greater than the design load there will be a line contact at the point farthest from the orbiting scroll if there is continued deflection. These designs overcompensate in that the desired contact surface must deform to obtain an even contact with the bushing or slider block which is actually applying the load. However, it is only at one load, with tolerances, in which the parts align for surface contact.

Commonly assigned U.S. patent application Ser. No. 734,009 filed Jul. 22, 1991 provides a curved surface on the drive pin or bore of the slider block such that linear contact occurs between the two members. Upon flexure or canting of the drive pin and/or crankshaft under load, the line of contact moves relative to the surfaces but remains at essentially the same axial position. The foregoing solutions do not address the coaction between the slider block and orbiting scroll relative to edge loading due to misalignment due to clearances and tolerances.

SUMMARY OF THE INVENTION

Load induced shaft deflections and excursions of the orbiting scroll of a scroll compressor can create a situation which results in edge loading of the orbiting scroll drive bearing.

Specifically, the deflection of the cantilevered drive pin and/or crankshaft together with tipping of the orbiting scroll due to gas and tangential forces exacerbates the existing tendency for edge loading between the slider block and the bearing surface of the hub of the orbiting scroll due to clearances for lubrication, manufacturing tolerances and wear. According to the teachings of the present invention, the slider block is moved with the deflection of the cantilevered drive pin and/or crankshaft. As a result, the slider block moves relative to the bore of the bearing such that edge loading is avoided.

It is an object of this invention to prevent edge loading in the hub bearing of an orbiting scroll.

It is another object of this invention to have a centrally loaded bearing under any operating condition.

It is an additional object of this invention to maintain the bearing and therefore the slider block in alignment even in the event of instability of the orbiting scroll. These objects, and others as will become apparent hereinafter, are accomplished by the present invention.

Basically, the outer surface of a slider block is at least partially barrel shaped and/or conical shaped so that it is capable of movement and accommodation relative to the corresponding cylindrical surface of the bearing surface so that edge loading is avoided.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
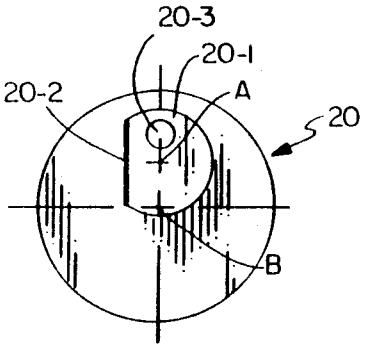
FIG. 1 is an end view of a crankshaft for use in a scroll compressor employing the present invention.
Figure 2:
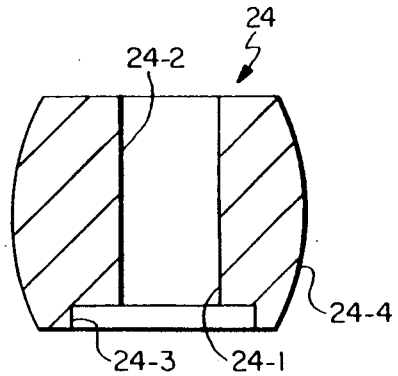
FIG. 2 is a sectional view through a slider block having a barrel shaped outer surface.

In FIG. 1, the numeral 20 generally designates a crankshaft. Crankshaft 20 has an eccentrically located drive pin 20-1. Drive pin 20-1 has a flat portion 20-2 and a bore 20-3 which is part of an oil distribution system formed in crankshaft 20. The point A represents the axis of the drive pin 20-1 while the point B represents the axis of the crankshaft 20. In FIG. 2 the numeral 24 generally designates a slider block having a bore 24-1 with a flat portion 24-2 and a counterbore 24-3. The slider block 24 has an outer surface 24-4 of a barrel shape.

Figure 4:
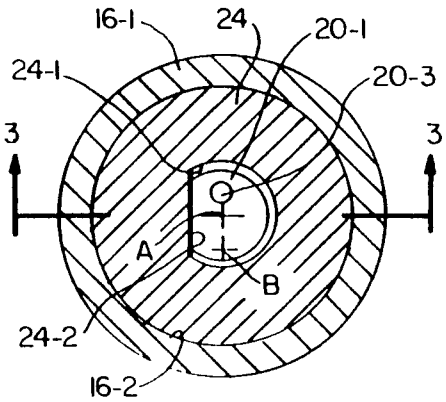
FIG. 4 is a sectional view taken along line 4—4 of FIG. 3.
Figure 3:
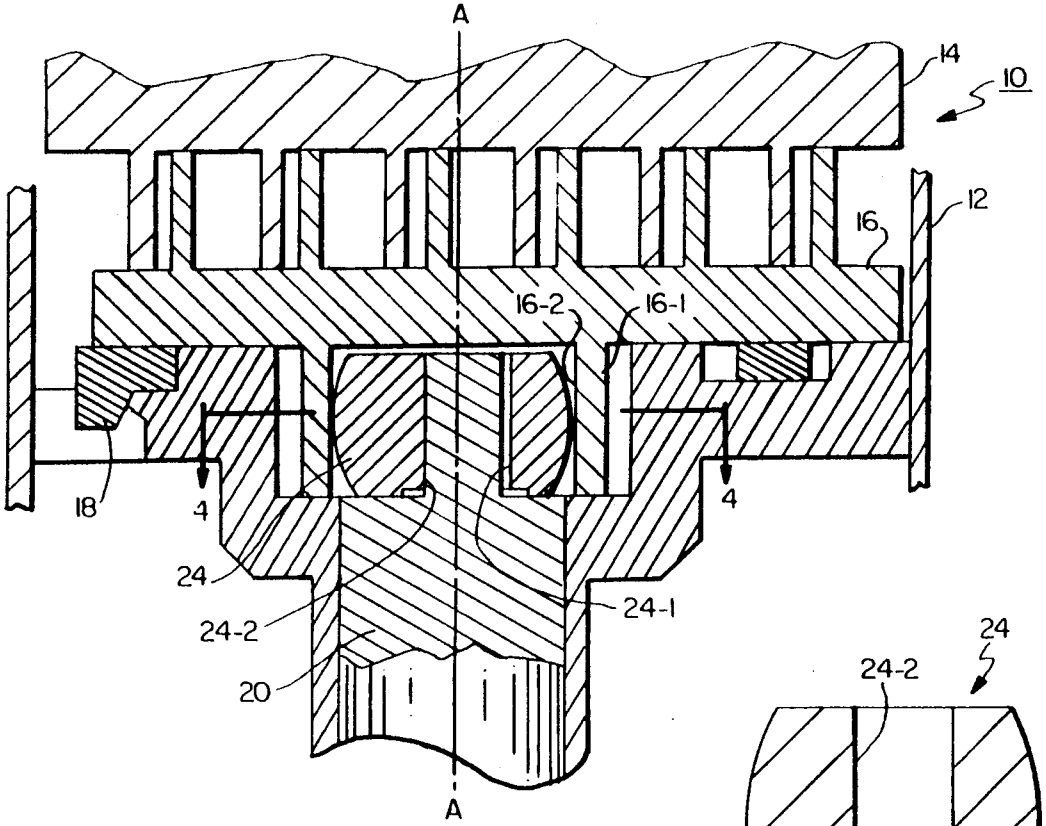
FIG. 3 is a partial vertical sectional view of a scroll compressor employing the crankshaft of FIG. 1 and the slider block of FIG. 2 taken along line 3—3 of FIG. 4.

In FIG. 3, the numeral 10 generally designates a hermetic scroll compressor having a shell 12. Fixed scroll 14 and orbiting scroll 16 are located within shell 12 and coact to compress gas, as is conventional. Orbiting scroll 16 has an axially extending hub 16-1 having a bore 16-2. As best shown in FIG. 4, slider block 24 is located in bore 16-2. Crankshaft 20 is driven by a motor (not illustrated) and axially extending, eccentrically located drive pin 20-1 is received in bore 24-1 such that flat portion 24-2 is able to move in a direction parallel to flat portion 20-2 of drive pin 20-1. Flat portion 20-2 of drive pin 20-1 defines a driving surface in contact with flat portion 24-2 of bore 24-1.

Figure 5:
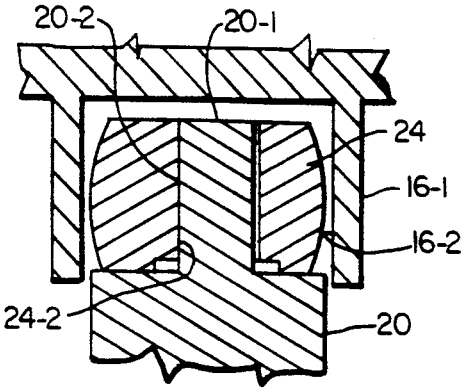
FIG. 5 is a sectional view showing the contact between the slider block and the hub of FIG. 4 at no or low load.
Figure 6:
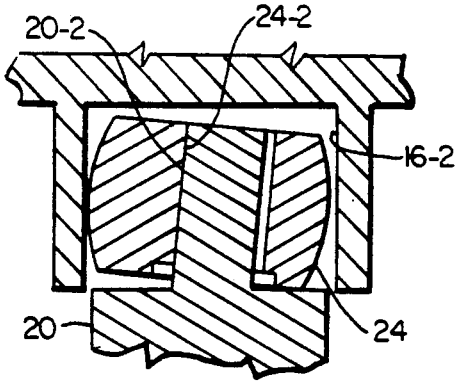
FIG. 6 is a sectional view showing the contact between the slider block and hub of FIG. 4 under heavy load with an exaggerated showing of the resultant movement.
Figure 7:
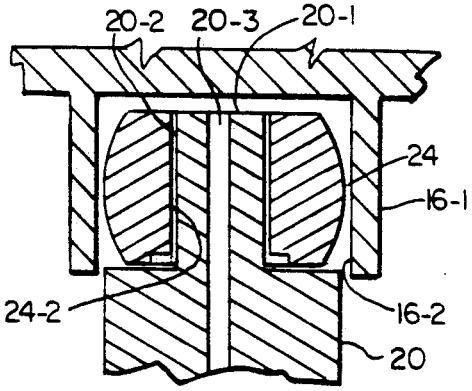
FIG. 7 is a view approximately 90° from the view of FIG. 6.
Figure 8:
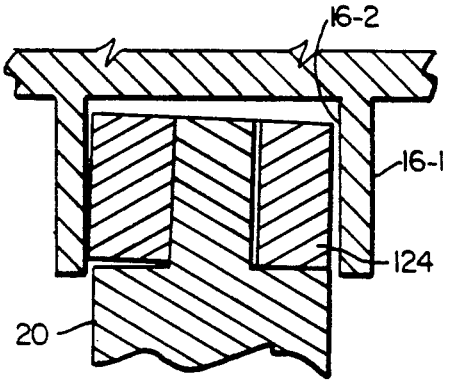
FIG.8 Prior Art
FIG. 8 is a view corresponding to FIG. 6 for a PRIOR ART cylindrical slider block coacting with a cylindrical bearing.

When compressor 10 is being operated, the motor (not illustrated) causes crankshaft 20 to rotate about its axis, which appears as point B in FIGS. 1 and 4. Crankshaft 20 rotates with integral, eccentrically located drive pin 20-1. Drive pin 20-1 has an axis A—A which appears as point A in FIGS. 1 and 4. Thus, rotation of crankshaft 20 about its axis causes the axis A—A of drive pin 20-1 to rotate about the point B as shown in FIGS. 1 and 4. The distance between points A and B represents the radius of orbit of orbiting scroll 16. Since drive pin 20-1 is located in and is nominally coaxial with bore 24-1 within their degree of relative movement, rotation of drive pin 20-1 causes slider block 24 to rotate therewith about the axis of crankshaft 20 as represented by point B. Because flat portion 20-2 contacts and drives flat portion 24-2, slider block 24 rotates as unit with drive pin 20-1 with the only relative movement being that permitted by the clearance between drive pin 20-1 and bore 24-1. Slider block 24 is located in and is coaxial with bore 16-2. As slider block 24 rotates, it causes orbiting scroll 16 to orbit, rather than rotate therewith, due to the coaction of Oldham coupling 18 with orbiting scroll 16. Thus, there is relative rotary movement of slider block 24 with respect to orbiting scroll 16. With the compressor 10 operating as described, gases are compressed by the coaction of the fixed and orbiting scrolls which is accompanied by the compressed gas acting on the fixed and orbiting scrolls and tending to cause their radial and axial separation. The radial separation forces are transmitted via hub 16-1 to slider block 24. Referring now to FIG. 5 which represents a no load or very low load condition, it will be noted that drive pin 20-1 is in an unstressed position with flat surface 20-2 being in surface contact with flat portion 24-2. The hub 16-1 acts as a bearing with respect to slider block 24. Referring now to FIG. 6 which represents a heavily loaded condition, it will be noted that drive pin 20-1 has been deflected relative to the FIG. 5 position and that slider block 24 has moved as a unit therewith to produce unidirectional misalignment due to the forces. Surfaces 20-2 and 24-2 remain in contact. The deflection is from the load which acts on, nominally 180° of the slider block 24 which runs eccentrically in bore 16-2 since it is driven through eccentrically located drive pin 20-1. Oil is supplied via an oil distribution system including bore 20-3 so that an oil film exists between the slider block 24 and the surface of bore 16-2. At the load point, which is the point of closest proximity/contact and the critical minimum oil film location, it will be noted that, allowing for the exaggerated curvature of surface 24-4, the minimum film thickness is generally at a mid point and does not vary greatly with distance as compared to cylindrical surfaces as shown in FIG. 8. Thus, in the FIG. 8 configuration, the point of closest proximity/contact is at an edge resulting in edge loading and there is a constantly increasing separation-/oil film thickness with distance for the full height-/length of the slider block 124. In contrast, in the device of FIGS. 2–7, with the point of closest proximity being at a mid point, as illustrated in FIG. 6, there is less variation in the clearance resulting in a more evenly distributed film pressure and more load capacity. FIG. 7 which represents a position approximately 90° from In the FIG. 6 position, it will be noted that there is even less variation since both sides of the section are nominally spaced 90° from the point of closest proximity and therefore from the plane of deflection, they are nominally symmetrical. Referring specifically to FIG. 8 which represents the PRIOR ART, it will be noted that the slider block 124 has a sharply defined minimum film area which is subject to edge loading and that the slider block 124 diverges more sharply from bore 16-2 than does slider block 24 and the film is less symmetrical.

Figure 9:
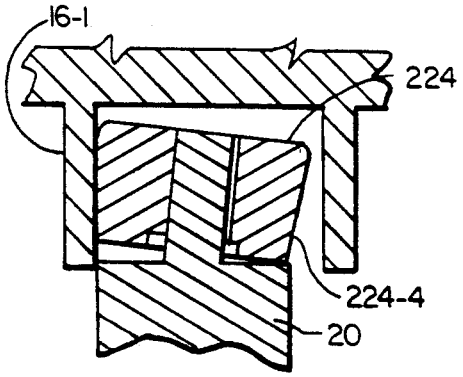
FIG. 9 is a view corresponding to FIG. 6 for an inverted frustoconical slider block.
Figure 10:
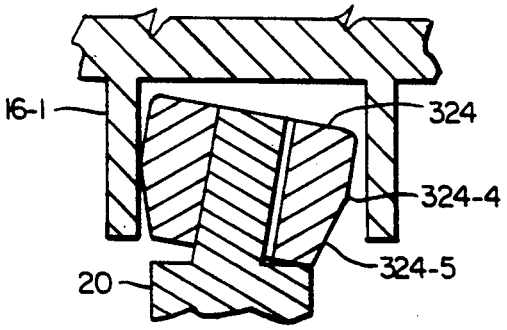
FIG. 10 is a view corresponding to FIG. 6 for a slider block having a cylindrical and a frustoconical portion.
Figure 11:
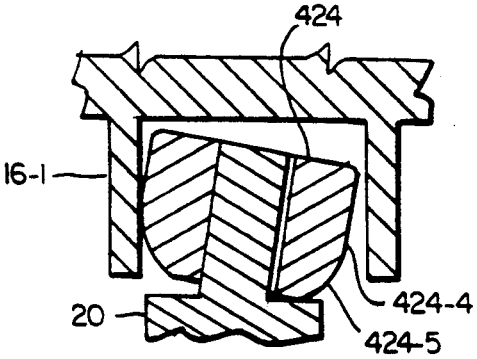
FIG. 11 is a view corresponding to FIG. 6 for a slider block having a cylindrical and a half barrel portion.

In FIG. 9, the slider block 224 has an outer surface 224-4 defining an inverted frustoconical surface which has a uniform oil film at the point/line of contact, as illustrated. Because slider block 224 is loaded into a uniform oil film, as illustrated, it has more bearing capacity and it takes a much higher loading to result in edge loading than the FIG. 8 device. In FIG. 10, the outer surface of slider block 324 has a cylindrical portion 324-4 and a frustoconical portion 324-5. In FIG. 11 the outer surface of slider block 424 has a cylindrical portion 424-4 and a barrel portion 424-5.

In comparing slider blocks 24 of FIG. 6, 224 of FIG. 9, 324 of FIG. 10 and 424 of FIG. 11, it will be noted that each has a more uniform oil film thickness in the region of highest pressure than PRIOR ART slider block 124 of FIG. 8. Slider block 224, specifically, has a uniform oil film in the region of highest pressure. By having a larger and more uniform minimum oil film the present invention avoids edge loading effects associated with a localized minimum film region. The larger and more uniform oil film is achieved by having the radial dimension of the slider block increase with axial distance from the crankshaft for at least a portion of its height.

Although preferred embodiments of the present invention have been illustrated and described, other changes will occur to those skilled in the art. It is therefore intended that the present invention is to be limited only by the scope of the appended claims.

What is claimed is:

1. A slider block for providing radial compliancy in a scroll compressor comprising:

an annular member having an axis, a first and a second end, an axially extending bore extending from said first end to said second end and having an axially extending flat section;

said annular member having an outer axially extending surface radially spaced from said axis;

said outer axially extending surface being variably radially spaced from said axis between said first and second ends.

2. The slider block of claim 1 wherein said outer axially extending surface is barrel shaped.

3. The slider block of claim 1 wherein said outer axially extending surface is frustoconical.

4. The slider block of claim 1 wherein at least a portion of said outer axially extending surface is barrel shaped.

5. The slider block of claim 1 wherein at least a portion of said outer axially extending surface is frustoconical.

6. In a scroll compressor having a crankshaft, an eccentrically located drive pin axially extending from said crankshaft and having a axially extending flat surface, a slider block having an axially extending bore with a flat section for receiving said drive pin such that said flat surface and said flat section are in engagement, an orbiting scroll having a hub with a bore formed therein for receiving said slider block whereby said bore in said hub receives said slider block in a bearing relationship, the improvement comprising:

said slider block having a radially increasing dimension in an axial direction going from said crankshaft for an axial distance so as to define a varying outer surface whereby upon load induced forces acting on said orbiting scroll, said hub is forced into contact with said slider block causing said slider block to move as a unit with said crankshaft and drive pin, at least one of which is deflected, such that said slider block is canted in said bore in said hub such that said varying outer surface of said slider block is moved relative to said bore in said hub so as to produce a relatively uniform spacing therewith defined by an oil film supporting said outer surface in a region of greatest loading and edge loading forces are avoided.

7. The improvement of claim 6 wherein said varying outer surface is barrel shaped.

8. The improvement of claim 6 wherein said varying outer surface is frustoconical.

9. The improvement of claim 6 wherein said slider block further includes an outer surface of uniform radial dimension.

10. A scroll compressor means comprising:

a fixed scroll;

an orbiting scroll having an axially extending hub with a bore formed therein;

a crankshaft having an axis;

a eccentrically located drive pin axially extending from said crankshaft and having an axially extending flat surface;

an annular slider block having an axially extending bore with a flat section for receiving said drive pin such that said flat surface and said flat section are in engagement;

said slider block having an outer axially extending surface radially spaced from said bore in said slider block and located in said bore in said hub in operative relationship therewith;

said outer axially extending surface having a portion having a radially increasing dimension in an axial direction going from said crankshaft whereby when said orbiting scroll is driven and coacts with said fixed scroll to compress a fluid, load induced forces acting on said orbiting scroll force said hub into contact with said outer axially extending surface through an oil film causing said slider block to move as a unit with said crankshaft and drive pin, at least one of which is deflected, such that said outer axially extending surface is canted with respect to said bore in said hub such that said portion having a radially increasing dimension is located at a relatively uniform spacing with said bore in said hub through said oil film supporting said outer axially extending surface in a region of greatest loading and edge loading forces are avoided.

11. The scroll compressor means of claim 10 wherein said portion having a radially increasing dimension is barrel shaped.

12. The scroll compressor means of claim 10 wherein said portion having a radially increasing dimension is frustoconical.

* * * * *